US007934564B1

(12) United States Patent
Stell et al.

(10) Patent No.: US 7,934,564 B1
(45) Date of Patent: May 3, 2011

(54) STOVETOP FIRE SUPPRESSION SYSTEM AND METHOD

(75) Inventors: Andrew W. Stell, Aledo, TX (US); Preston N. Weintraub, Keller, TX (US)

(73) Assignee: Williams-Pyro, Inc., Fort Worth, TX (US)

( * ) Notice: Subject to any disclaimer, the term of this patent is extended or adjusted under 35 U.S.C. 154(b) by 250 days.

(21) Appl. No.: 12/240,081

(22) Filed: Sep. 29, 2008

(51) Int. Cl.
*A62C 3/00* (2006.01)
*A62C 37/10* (2006.01)

(52) U.S. Cl. ..... 169/65; 169/26; 169/60; 169/70

(58) Field of Classification Search ..... 169/28, 169/59, 65, 43, 26, 60, 70
See application file for complete search history.

(56) References Cited

U.S. PATENT DOCUMENTS

| | | | | |
|---|---|---|---|---|
| 5,518,075 | A | 5/1996 | Williams | |
| 6,029,751 | A | 2/2000 | Ford et al. | |
| 6,044,913 | A * | 4/2000 | Stehling et al. | 169/65 |
| 6,105,677 | A | 8/2000 | Stager | |
| 6,276,461 | B1 | 8/2001 | Stager | |
| 6,819,237 | B2 * | 11/2004 | Wilson et al. | 340/539.26 |
| 7,182,143 | B2 | 2/2007 | Hall et al. | |
| 7,472,758 | B1 * | 1/2009 | Stevens et al. | 169/43 |
| 2004/0145466 | A1 | 7/2004 | Anthony et al. | |
| 2009/0294141 | A1 * | 12/2009 | Rouse et al. | 169/65 |

* cited by examiner

*Primary Examiner* — Dinh Q Nguyen
(74) *Attorney, Agent, or Firm* — Morani Patent Law, PC

(57) ABSTRACT

A stovetop fire suppression system is provided which senses the stovetop environment, assesses a fire condition, and limits a fuel or electricity heat source upon determination of a stovetop fire condition. Either, or both of, sound or heat may be monitored for the presence of a fire. Sensed day can be processed for spectral density or rate of rise for subsequent comparison to thresholds or predetermined density values. Upon determination of a stovetop fire condition a fire suppression module triggers, for example, a valve or switch to extinguish the stovetop heat source.

6 Claims, 3 Drawing Sheets

STOVETOP FIRE SUPPRESSION SYSTEM AND METHOD

STATEMENT REGARDING FEDERALLY SPONSORED RESEARCH OR DEVELOPMENT

This invention was made with government support under Contract No. NIST SB 1341-03-C-0034 between the National Institute of Standards and Technology and Williams-Pyro, Inc. The government has certain rights in the invention.

BACKGROUND OF THE INVENTION

Household fires oftentimes result from kitchen stovetop fires, such as, for example, stovetop grease fires. One reason that stovetop fires can be particularly dangerous is that stoves are commonly positioned adjacent to a ready fuel source, for example kitchen cabinets. In order to reduce the risk of household fires, fire suppression devices have been devised, which automatically release a powder to suppress a stovetop fire, at least in part by smothering flames. Such a device is effective to put out a stovetop flame; however the stove remains on after deployment of the fire suppressing powder and a flame may reignite over time.

While different signal mechanisms can be deployed to indicate release of the flame suppressing matter, attendance to the stovetop is not automated or guaranteed. Perhaps a resident has stepped outside the dwelling or has fallen asleep. Any audible or visual signal may go unnoticed. A smoke alarm may not be timely triggered, or triggered at all, in view of the released fire suppressing matter. It would be desirable to quench the initial stovetop flame and automatically cutoff the heat energy source, avoiding a secondary fire over time.

Conventional automatic cutoff valves are typically associated with a period of non-use. A conventional cutoff does not actuate upon the detection of a stovetop fire and release of a flame suppressant.

BRIEF DESCRIPTION OF THE DRAWINGS

For more complete understanding of the features and advantages of the present invention, reference is now made to the detailed description of the invention along with the accompanying figures, wherein.

DETAILED DESCRIPTION OF THE DRAWINGS

Figure 2:
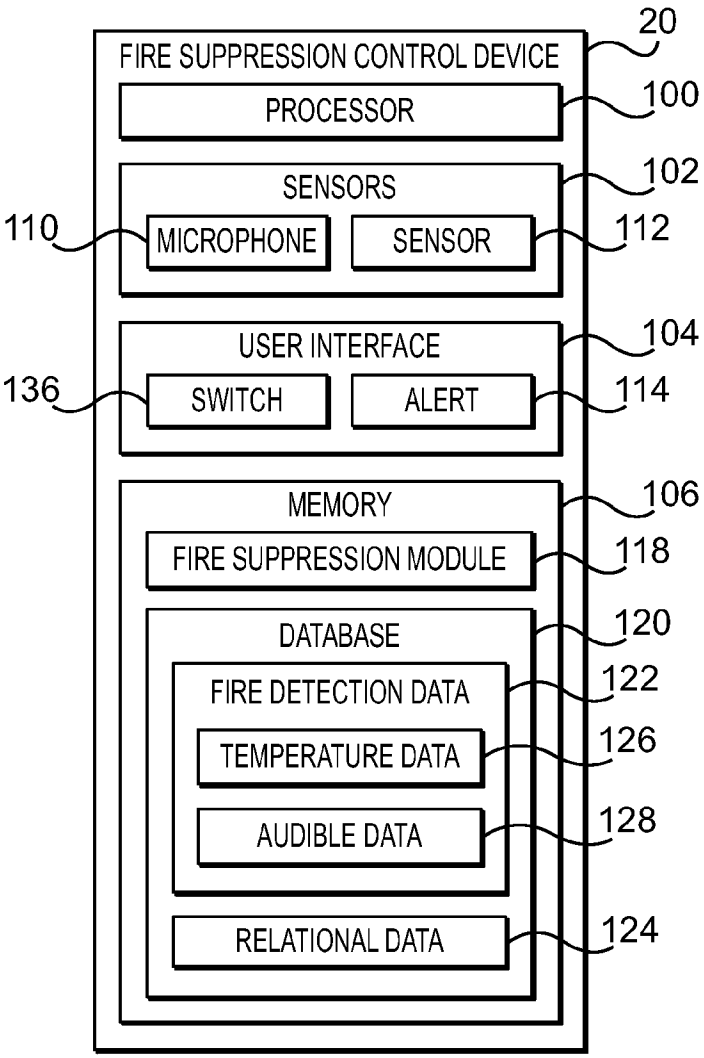
FIG. 2 is a block diagram illustrating an exemplary fire suppression control device of the fire suppression system of FIG. 1.

In the description which follows like parts are marked throughout the specification and drawings with the same reference numerals, respectively. The drawing figures may not be to scale and certain features may be shown exaggerated in scale or in somewhat schematic form in the interest of clarity and conciseness.

Figure 1:
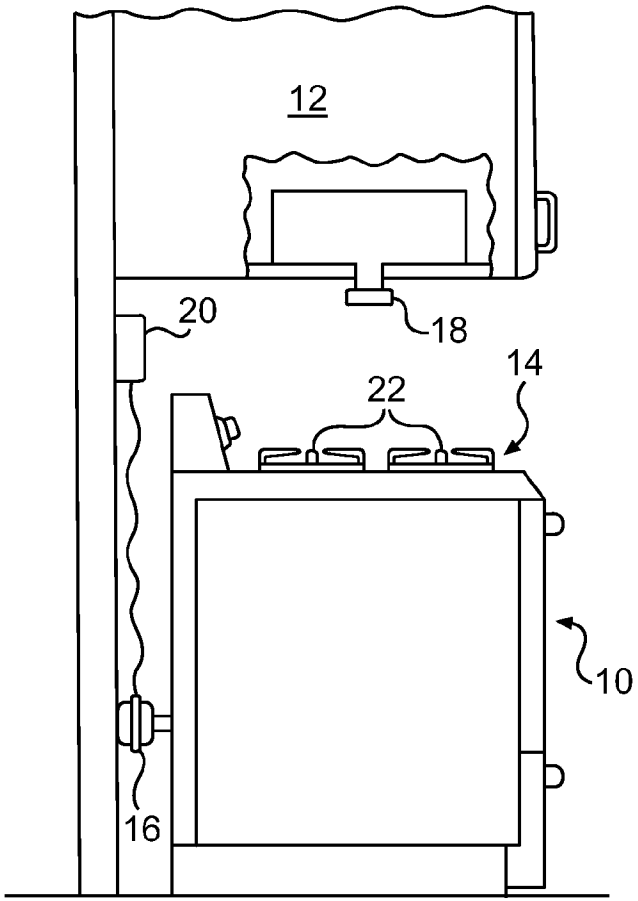
FIG. 1 is an illustration of a stove in which a fire suppression system in accordance with an embodiment of the present invention is employed to advantage.

FIG. 1 is an illustration of a stove 10 in which a fire suppression system 12 is employed to advantage. In the embodiment illustrated in FIG. 1, fire suppression system 12 comprises stove 10 having a stovetop 14, a valve/switch 16 for regulating the flow of gas and/or electricity to stove 10, a fire suppressor 18 and a fire suppression control device 20. In FIG. 1, stove 10 may comprise any type of conventional stove having a gas or electric heating elements 22. In FIG. 1, fire suppression control device 20 is communicatively coupled to valve/switch 16 to turn off stove 10 by controlling the flow of gas or electricity to stove 10 during a detected fire condition. In operation, fire suppression control device 20 is operable to monitor the conditions on stovetop 14 to detect a stovetop fire and subsequently send a command to actuate valve/switch 16 to turn off the gas or electricity to stove 10. For example, in the event stove 10 is a gas operated stove, fire suppression control device 20 is configured to send a signal to close valve/switch 16 to cut-off the gas supply to stove 10. Similarly, in the event stove 10 is an electric stove, fire suppression control device 20 is configured to automatically turn off power to stove 10 via valve/switch 16. According to some embodiments, valve/switch 16 may be an electrically-controlled valve/switch to control the flow of gas or electricity to stove 10. According to one embodiment, valve/switch 16 is controlled by an electromagnetic solenoid actuator (not illustrated). In operation, the valve is in the "OFF" state to prohibit gas or electricity flow until electric current is supplied to the solenoid. In the embodiment illustrated in FIG. 1, fire suppression control device 20 is mounted on an adjacently positioned wall near and/or otherwise adjacent to stovetop 14 to monitor the conditions thereon. It should be understood, however, that fire suppression control may be otherwise positioned, such as, for example, disposed directly on stove 10 to monitor the conditions of stovetop 14.

In the exemplary embodiment illustrated in FIG. 1, fire suppressor 18 is mounted above stovetop 14 and is configured to release a suppressing powder directly onto stovetop 20 to smother a stovetop fire. In operation, fire suppressor 18 is actuated upon contact with a flame from the stovetop fire. For example, in the exemplary embodiment illustrated in FIG. 1, as a flame contacts fire suppressor 18, the flame lights a fuse (not illustrated) disposed on suppressor 18 to thereby ignite a black powder substitute charge, which in turn releases the fire suppressing powder stored within suppressor 18. According to some embodiments, ignition of a combustable propellant, not only releases fire suppressing powder, but also creates an audible alarm signal to alert individuals located near stove 10 of the stovetop fire condition. For example, a near 140 decibel burst is emitted upon ignition of the black powder substitute propellant comprised in a STOVETOP FIRESTOP® fire suppressor (Williams Pyro, Inc., Fort Worth, Tex., USA). In accordance with the present invention, sensing this sound burst, which can be, for example, at 140 decibels, can actuate fire suppression control device 20 as discussed in further detail below.

FIG. 2 is a block diagram illustrating an exemplary fire suppression control device 20 of the fire suppression system 12 of FIG. 1. In the embodiment illustrated in FIG. 2, fire suppression control device 20 comprises a processor 100, sensors 102, a user interface 104, and a memory 106. In the embodiment illustrated in FIG. 2, sensors 102 comprise a microphone 110 to detect audible sounds associated with fire suppressor 18 and a heat sensor 112 to detect heat released from a fire on stovetop 14. In the embodiment illustrated in FIG. 2, user interface 104 comprises an alert 114 to indicate the detection of a fire condition by fire suppression control device 20 and a manual reset switch 136. According to some embodiments, alert 114 comprises a two-color light emitting diode (LED) such that in the event of a fire condition on stovetop 14, the LED changes colors; however, it should be understood that alert 114 may be otherwise configured (e.g., configuring LED to blink or providing an audible alarm).

Manual reset switch 136 enables a user to manually clear an alarm condition and turn on or off gas or electricity to stove 10. For example, when fire suppression system 12 is in the ON state, a user can press switch 136 to turn off the gas or electricity. By allowing a user to manually turn the gas or electricity off, suppression system 12 provides a convenient way to interrupt power or gas to the stove when the stove is not being used for extended periods, such as, for example, when the user leaves for vacation. When fire suppression system 12 is in the OFF state, the user can press switch 136 to turn on the gas or electricity. According to some embodiments, alert 114 changes status (e.g., from green to red) when a user actuates switch 136 to the OFF position. Likewise, alert 114 changes status (e.g., from red to green) when a user actuates switch 136 to the ON position. In the embodiment illustrated in FIGS. 1 and 2, if a user manually turns the gas or electricity on via switch 136, an audible alert may also be incorporated to alert the user the presence of gas or electricity to stove 10.

In FIG. 2, memory 106 comprises fire suppression module 118 and a database 120. Fire suppression module 118 may comprise hardware, software, firmware, or a combination thereof. In FIG. 2, fire suppression module 118 is illustrated as being stored in memory 106 so as to be accessible and/or executable by processor 100. However, it should be understood that fire suppression module 118 may be otherwise stored.

In the embodiment illustrated in FIG. 2, database 120 comprises fire detection data 122 and relational data 124. Fire detection data 122 comprises information associated with signals detected and/or otherwise received by sensor(s) 102 such as, by way of example, signals corresponding to temperature data 126 (e.g., indicating the heat released from a fire on stovetop 14) and audible data 128 (e.g., indicating an audible signal level associated with actuation of fire suppression device 18).

In FIG. 2, relational data 124 comprises information used to evaluate fire detection data 122 such as, but not limited to, known and/or predetermined signal values such as temperature values corresponding to heat released from flames on stovetop 14 resulting from a fire, rate of temperature rise, and/or decibel level values associated with the actuation of fire suppression device 18. Thus, relational data 124 comprises information used to analyze and/or evaluate fire detection data 122 to determine whether fire suppression module should send a signal to shut-off and/or otherwise actuate valve/switch 16 (FIG. 1).

In operation, relational data 124 is compared against fire detection data 122 by fire suppression module 118 to determine whether a fire exists on stovetop 14. If fire detection data 122 exceeds a predetermined threshold or range as compared to relational data 124 for a non-fire condition on stovetop 14, fire suppression module 118 transmits and/or otherwise generates a signal to turn off the fuel supply (e.g., gas or electricity) to stove 10. For example, in some embodiments, fire suppression module 118 is configured to control actuation of valve/switch 16 (FIG. 1) to prevent gas or electricity flow to stove 10 by monitoring heat, rate of rise of heat, and sound. Thus, heat generated from a fire on stovetop 14 is measured by heat sensor 112 and sound generated by fire suppression device 18 is measured by microphone 110. Fire suppression module 118 compares fire detection data 122 to relational data 124 to determine whether to generate a signal to actuate valve to prohibit the flow of gas or electricity to stove 10. Rate of rise may be determined, for example, by a processor comprised in fire suppression module 118, from temperature data collected at a given interval. According to one exemplary embodiments temperature sensed data is recorded at two minute intervals for rate of temperature rise determination.

According to some embodiments, fire suppressor 18, when triggered, produces an approximately 140 decibel audible alarm signal, This high decibel sound may enable control device 20 to easily distinguish the alarm signal from other sounds in the local environment. In addition to a maximum decibel level or as an alternative in still other embodiments, a Fast Fourier Transform (FFT) may be used to determine a spectral signature from a sensed signal. The output of the FFT may be compared to a spectral signal of a recording of a known alarm signal, relational data. In some embodiments, using spectral comparisons may reduce, or even eliminate false alarms generated by fire suppression control device 20.

It should be understood that valve/switch 16 may be actuated via fire suppression module 18 utilizing any number of and combination of sensors 110. For example, fire suppression module may actuate valve/switch 16 upon detection of a fire condition by monitoring only heat conditions, only sound conditions or a combination thereof. However, in accordance with one embodiment, it should be understood that by monitoring both heat and sound, false alarms generated by suppression module may be reduced and/or substantially eliminated. For example, by utilizing a combination of different types of sensors (e.g., at least one microphone 110 and at least one heat sensor 112), an exact alarm audible signature is not necessary (e.g., distinguishing the approximately 140 decibel audible alarm signal generated by suppressor 18 from other loud noises, such as banging of pots and pans, dropped items, etc.) since input from heat sensor 112, in addition to input from microphone 110, is necessary to actuate valve/switch 16. Thus, in the event a noise of near 140 decibel is detected by microphone 110 from, for example, a dropped pan, fire suppression module 118 will not transmit a signal to actuate valve/switch 16 until fire suppression module determines that fire detection data 122 also falls outside the predetermined value range indicated by relational data 124 for a non-fire condition on stovetop 14.

Figure 3:
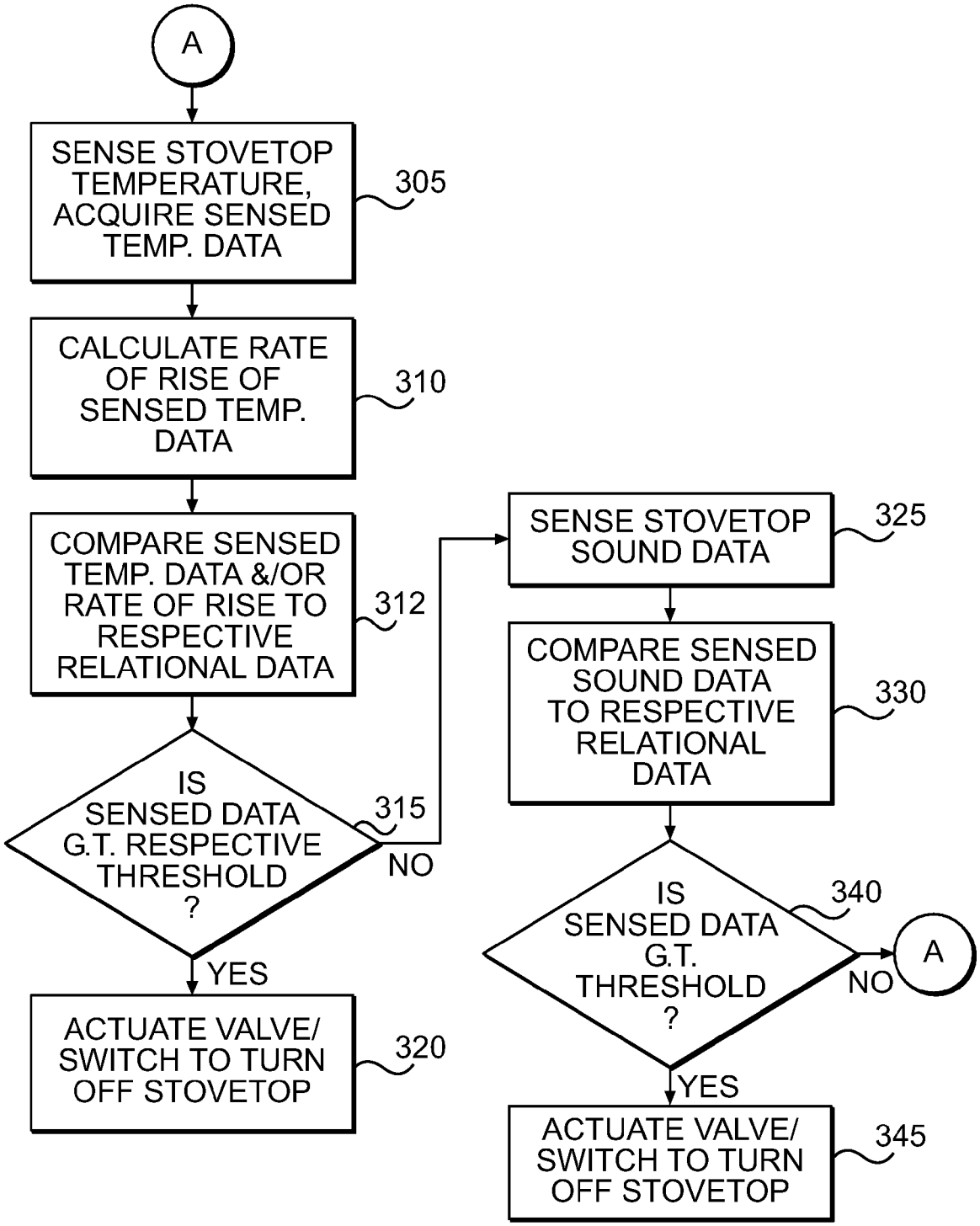
FIG. 3 is a block diagram of a method of fire suppression in accordance with an exemplary embodiment of the present invention.
Figure 4:
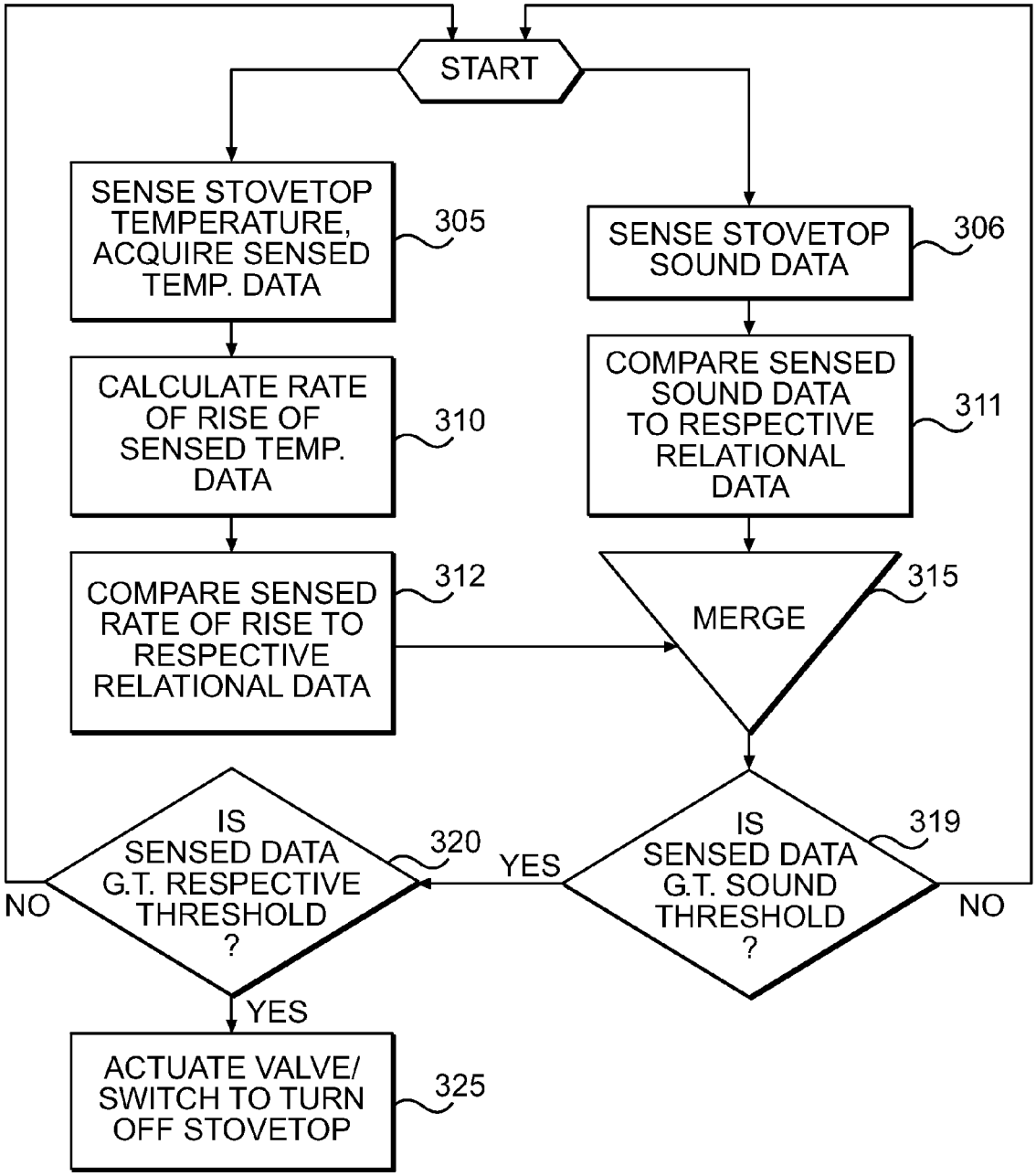
FIG. 4 shows a block diagram of an embodiment of a method of fire detection and suppression, wherein a combination of a rate of rise of temperature and sound will actuate the valve or switch to turn off the stove.

FIG. 3 shows a block diagram of a method of fire suppression in accordance with an exemplary embodiment of the present invention. Referring to FIG. 3, stovetop temperature data is sensed 305 using at least one temperature sensor. The rate of rise of sensed temperature data is calculated 310 and a comparison is made between sensed data and respective relational data 312. Comparison may include an absolute temperature data and/or rise in temperature data as a function of time. If sensed data exceeds respective threshold 315, a fire suppression module actuates a valve/switch to turn off the energy to the stovetop 320, either gas or electricity. If the sensed data does not exceed threshold, stovetop sound data is sensed 325 and sensed data is compared to respective relational data 330. If the sensed sound data exceeds threshold 340, then the fire suppression module actuates a valve/switch to turn off the energy to the stovetop 345, either gas or electricity. In alternate embodiments sound and temperature are continuously sensed and recorded in memory for comparison to respective relational data. In yet another embodiment, dual temperature, absolute or rate of rise, thresholds may be employed in determining the presence of a fire. In accordance with one embodiment, a first temperature threshold in combination with an exceeded sound sense threshold may actuate a valve/switch to turn off the stovetop. While a second temperature threshold may yield activation of the valve/switch to turn off the stovetop irrespective of sensed sound data. In yet another embodiment, sound threshold alone can be used to determine the presence of a stovetop fire and the fire suppression module will activate the valve/switch to turn off the stove top. FIG. 4 shows a block diagram of an embodiment of a method of detection and suppression, wherein a combination of a rate of rise of temperature and sound will actuate the valve or switch to turn off the stove.

Sensor data is acquired from at temperature and a sound sensor 305, 306. The rate of rise of sensed temperature data is calculated 310. Comparisons are made between the sensed sound data and calculated rate of rise of sensed temperature data to respective relational data 311, 312. These steps can be performed in parallel or series, and are shown in FIG. 4 as occurring in parallel. If sensed sound data exceeds sound threshold and if calculated rate of rise of sensed temperature data exceeds threshold 319, 320, then the valve or switch is actuated to turn off the stovetop 325. If either sensed sound or sensed rate of temperature rise does not exceed its respective threshold, then monitoring continues with sensing and acquiring of stovetop data 305, 306.

In accordance with the present invention, fire suppression module 118 may trigger either of an electrically controlled valve or an electrical switch 16. In the case of a gas stove, valve 16 comprises an electrically-controlled valve to open or close gas to the stove. The valve may be controlled by an electromagnetic solenoid actuator. In accordance with one exemplary embodiment, the valve is in the closed or off state until electric current is applied to the solenoid. In accordance with an exemplary embodiment following an onset pulse of 0.5 seconds, pulse width modulation (PWM) is used to maintain the valve in the open or on state. According to one exemplary embodiment 24 VDC is applied at the onset for 0.5 seconds and at approximately 4.8 VDC thereafter using PWM reducing power consumption by the solenoid valve 16 by up to 95 percent. In the case of an electrical switch for an electrical stove, PWM is not necessary.

In yet another embodiment, one of valve 16 or the fire suppression control device 20 comprises switch/valve state memory. In the event that power is interrupted to the fire suppression control device 20, the state of the switch/valve is preserved in memory. When the fire suppression control device 20 comes back on line, the switch valve returns to its position at the time of power loss. Switch state memory provides added safety. For example, in the event that a kitchen breaker is tripped, a stovetop user may not wish the stovetop to be powered up upon closing of the kitchen breaker.

The construction of fire suppression system 12 is believed to be understandable to those skilled in the art based on the foregoing description read in conjunction with the drawings. Conventional materials and components may be used to fabricate fire suppression system 12 described herein which are not otherwise described with respect to the type of material and components to be used for fabrication thereof.

Although exemplary embodiments of the invention have been described in detail, those skilled in the art will also recognize that various substitutions and modifications may be made without departing from the scope and spirit of the appended claims.

What is claimed is:

1. A stovetop fire suppression system, comprising:

a fire suppression control device comprising:

a processor;

a plurality of sensors comprising: at least one microphone and at least one temperature sensor;

a user interface;

a memory;

a fire suppression module; and a database comprising fire detection data and relational data, wherein, the processor determines a fire condition based on comparing at least two sensed conditions on a stovetop to respective relational data; and a fire suppressor device comprising a fuse and fire suppressing powder, wherein the fire suppressor device releases a fire suppressing powder when a flame contacts the fuse and emits an audible blast upon activation of the fire suppressor device; and wherein, the fire suppression control device sends a signal which activates a valve or a switch turning off energy to the stove based on the processor's determination of a fire condition.

2. The fire suppression system of claim 1, wherein the processor comprised in the fire suppression control device calculates a rate of rise of sensed temperature and compares calculated rate of rise of sensed temperature to respective relational data to determine a fire condition.

3. The fire suppression system of claim 1, wherein the fire suppression control device comprises a processor which compares a sensed temperature level to respective relational data to detect a fire condition.

4. The fire suppression system of claim 1, wherein the processor comprised in the fire suppression control device calculates a rate of rise of sensed temperature and compares calculated rate of rise of sensed temperature to respective relational data and compares a sensed temperature level to another respective relational data to determine a fire condition based on both comparisons.

5. The fire suppression system of claim 1, wherein:

the fire suppression control device comprises a signal processing module, which generates a power spectral signal from a sensed sound signal; and the fire suppression control device compares the generated signal to a relational spectral data to determine a fire condition.

6. The fire suppression system of claim 1, further comprising:

a switch state memory, wherein the switch state memory stores a state of the valve or of the switch before a power loss.

* * * * *